US006842946B2

(12) United States Patent
Hayden

(10) Patent No.: US 6,842,946 B2
(45) Date of Patent: Jan. 18, 2005

(54) INTERCHANGEABLE FASCIA FOR CABINET KNOB

(75) Inventor: Scott Hayden, Delaware, OH (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 62 days.

(21) Appl. No.: 10/042,781

(22) Filed: Jan. 9, 2002

(65) Prior Publication Data

US 2002/0138949 A1 Oct. 3, 2002

Related U.S. Application Data

(60) Provisional application No. 60/279,536, filed on Mar. 28, 2001.

(51) Int. Cl.[7] ..... A45C 13/22

(52) U.S. Cl. ..... 16/414; 16/441; 16/DIG. 40; 403/DIG. 1; 248/309.4

(58) Field of Search ..... 16/414, 417, 433, 16/441, DIG. 40; 248/309.4; 464/29; 403/DIG. 1; 292/347–355

(56) References Cited

U.S. PATENT DOCUMENTS

| | | | | | |
|---|---|---|---|---|---|
| 362,079 | A | | 5/1887 | Hetu | |
| 447,613 | A | | 3/1891 | Keil | |
| 1,701,776 | A | * | 2/1929 | Hinman | 16/441 |
| 1,803,375 | A | * | 5/1931 | Adams | 292/347 |
| 2,171,361 | A | | 8/1939 | Gits et al. | |
| 2,271,266 | A | | 1/1942 | Kost | |
| 2,503,495 | A | | 4/1950 | Koester | |
| 2,947,507 | A | * | 8/1960 | Schlage et al. | 248/206.5 |
| 3,037,256 | A | | 6/1962 | Chapman | |
| 3,243,837 | A | | 4/1966 | Smith | |
| 3,596,554 | A | | 8/1971 | Low et al. | |
| 4,158,216 | A | * | 6/1979 | Bigelow | 200/600 |
| 4,204,551 | A | * | 5/1980 | Robinson | 131/178 |
| 4,778,487 | A | | 10/1988 | Chenel | |
| 4,912,809 | A | | 4/1990 | Scheuer | |
| 4,986,059 | A | | 1/1991 | Boutilier | |
| 5,394,594 | A | | 3/1995 | Duran | |
| 5,410,785 | A | | 5/1995 | Huang | |
| 5,494,323 | A | | 2/1996 | Huang | |
| 5,509,174 | A | * | 4/1996 | Worrell | 16/441 |
| D436,627 | S | * | 1/2001 | Bardet | D19/90 |
| 6,477,749 | B1 | * | 11/2002 | Reiter | 24/303 |
| 6,594,861 | B2 | * | 7/2003 | Dimig et al. | 16/412 |

FOREIGN PATENT DOCUMENTS

| | | | |
|---|---|---|---|
| FR | 2741044 | * | 5/1997 |
| JP | 10-174655 | * | 6/1998 |

* cited by examiner

*Primary Examiner*—Suzanne Dino Barrett
*Assistant Examiner*—Mark Williams
(74) *Attorney, Agent, or Firm*—Edgar A. Zarins; Lloyd D. Doigan

(57) ABSTRACT

A cabinet knob construction which allows decorative aspects of the knob to be readily altered to vary the appearance of the hardware. A knob body mounted to the cabinet includes an axial bore which receives a magnetic disk and an insert sleeve. The sleeve has a non-circular interior configuration for receiving a metal stud affixed to a fascia member. The fascia member alters the front face of the knob body and the stud is maintained within the bore by the magnet. Removal of the fascia member allows replacement with a different member to alter the appearance of the hardware.

8 Claims, 2 Drawing Sheets

INTERCHANGEABLE FASCIA FOR CABINET KNOB

RELATED APPLICATIONS

This application claims priority from U.S. Provisional Application No. 60/279,536 filed on Mar. 28, 2001.

BACKGROUND OF THE INVENTION

I. Field of the Invention

This invention relates to decorative hardware for cabinets and, in particular, to a cabinet knob which includes interchangeable features to alter the appearance of the cabinet.

II. Description of the Prior Art

While cabinets and furniture pieces may be provided without hardware, decorative pieces for accenting the wood product while also facilitating manipulation of storage doors and drawers have become increasingly popular. Affixing such hardware to the drawer or door of a furniture piece allows the user to conveniently open the storage compartment while also improving the aesthetic appearance of the cabinet. Such hardware can be in the form of knobs, handles, pulls and levers affixed to the face of the furniture. Because the hardware is mounted using fasteners extending into the drawer face or door, it is difficult to replace such hardware in order to alter the appearance of the cabinet.

SUMMARY OF THE PRESENT INVENTION

The present invention overcomes the disadvantages of the prior known cabinet hardware by facilitating instantaneous interchange of either the knob body or the fascia of the knob to alter the decorative appearance of the furniture cabinets.

A first embodiment of the interchangeable decorative knob for a furniture cabinet includes a knob body which is secured to a facing of a drawer or a cabinet door using a fastener. The knob body may include a spherical head and a reduced neck portion although the present invention could be applied to a variety of knob configurations. An axial throughbore is formed in the knob body and will include threads at an inner end thereof to reduce the mounting fastener.

The face or outer end of the knob body is provided with a recess or similar cut-out extending substantially across the outer end of the body. The recess is coaxial and in communication with the throughbore. Inserted within the outer end of the throughbore proximate the recess is a magnetic disk and a sleeve. The magnetic disk has a center aperture and is mounted transversely within the throughbore. The sleeve has an outer surface which conforms to the configuration of the throughbore but a non-circular interior. The recess and sleeve insert are configured to removably receive a decorative fascia for altering the appearance of the knob. The fascia includes a faceplate configured to seat within the recess and a metal stud configured to be received within the sleeve insert. The cross-sectional configuration of the stud conforms to the non-circular configuration of the sleeve interior so as to prevent the fascia member from rotating. The fascia is maintained on the knob body by the magnetic forces acting on the stud as it sits proximate the magnetic disk. Preferably a push rod which can be inserted through the axial bore is used to overcome the magnetic forces and remove the fascia member.

An alternative embodiment of the present invention allows for convenient removal of the entire knob body. A knob stem is secured within the door or drawer panel. The stem including an axial push rod is reciprocally mounted in a stem housing and biased towards a first locking position. The push rod includes a circumferential groove. The stem housing includes a plurality of circumferentially spaced apertures each receiving a ball bearing. Moving the push rod to its first locking position will force the ball bearings radially outwardly. Upon alignment of the groove with the bearings, the bearings will be allowed to move radially inwardly The interchangeable knob body includes a partial axial bore adapted to matingly receive the stem housing. Upon mounting of the knob body to the stem housing, the push rod is moved to the locking position forcing the bearings radially outwardly into locking engagement with the knob body.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

The present invention is directed to a cabinet knob having an interchangeable decorative feature. The knob is generally mounted to a door or similar panel to assist in the opening and closing of the storage compartment. The present invention includes a fixed knob having an interchangeable fascia shown in FIGS. 1 through 3 and an interchangeable knob body shown in FIGS. 4 and 5.

Figure 1:
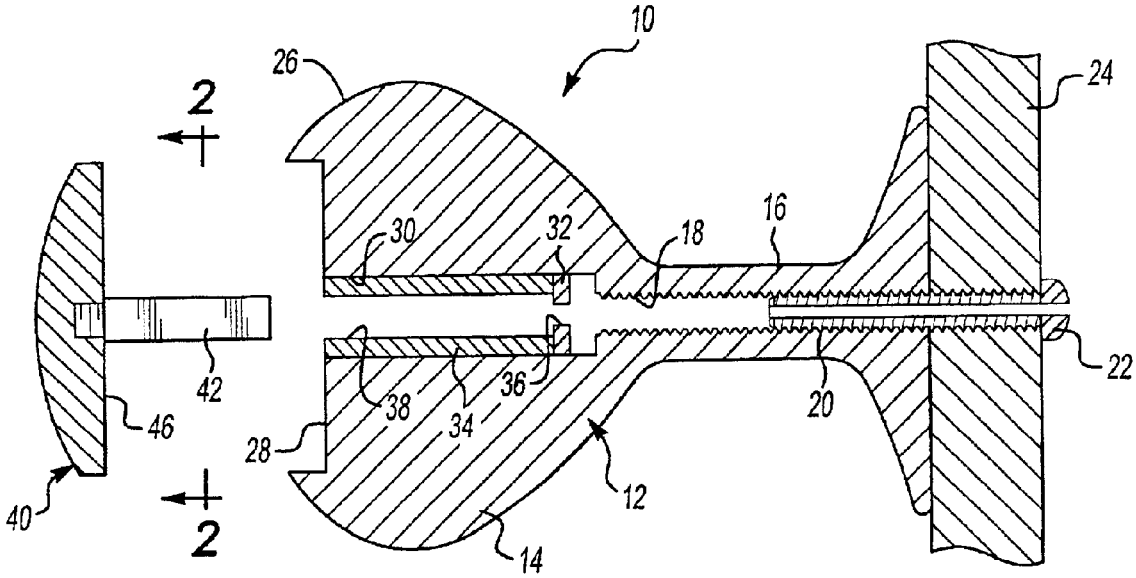
FIG. 1 is an exploded view of a furniture knob having an interchangeable fascia embodying the present invention.
Figure 2:
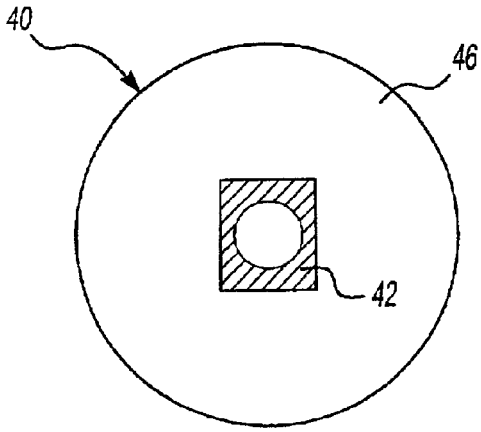
FIG. 2 is a rear view taken along lines 2—2 of FIG.
Figure 3:
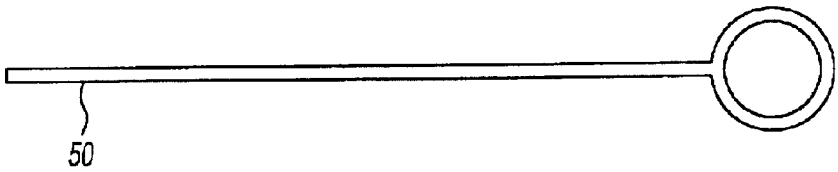
FIG. 3 is a side view of a push rod.

Referring first to FIGS. 1 through 3, there is shown a knob 10 for facilitating the opening and closing of a storage compartment. The knob 10 includes a knob body 12 having a substantially spherical head 14 and a reduced diameter neck portion 16. An axial bore 18 is formed through the knob body 12 and includes a threaded interior end 20. The threaded end 20 of the bore 18 is adapted to receive a fastener 22 for mounting the knob body 12 to a front panel 24 of the cabinet.

A front or outer end 26 of the knob body 12 includes a recess 28 or similar cut-out which essentially eliminates the outer face of the knob body 12. The recess 28 is formed coaxially with the throughbore 18. The outer end 30 of the throughbore 18 receives a magnetic disk 32 and a sleeve insert 34. The magnetic disk 32 is mounted transversely within the throughbore 18 and includes a center aperture 36. The sleeve 34 has an outer configuration which conforms to the bore 18 allowing it to be received within the bore 18. The interior 38 of the sleeve 34 has a non-circular cross-sectional configuration. In a preferred embodiment, the interior configuration is square although triangular, pentagonal, etc. configurations could be incorporated.

The non-circular configuration of the sleeve insert 34 is designed to prevent rotation of a fascia member 40 mounted to the knob body 12. The fascia member 40 includes a plate-like cap 42 designed to form the face of the knob 10 and a stud 44 extending perpendicular to a rear 46 of the cap 42. The stud 44 has the same configuration as the sleeve interior 38 to prevent rotation of the fascia member 40 relative to the knob body 12. Moreover, the stud 44 is made of a metal so as to be attracted to the magnetic disk 32 to maintain the stud 44 within the bore 18. Thus, the sleeve 34 prevents rotational movement to the fascia 40 while the magnetic disk 32 prevents longitudinal movement.

When it becomes desirable to replace the fascia member 40, a push rod 50 is employed to overcome the magnetic attraction of the disk 32. The push rod 50 is inserted through the bore 18 to push the stud 44 away from the magnet 32 allowing the fascia 40 to be removed and replaced with a different decorative member. The fascia member 40 is shown as seated within the recess 28 although a fascia plate 42 of larger or smaller size could be employed including a dome shaped member which covers the front half of the knob body 12.

Figure 4:
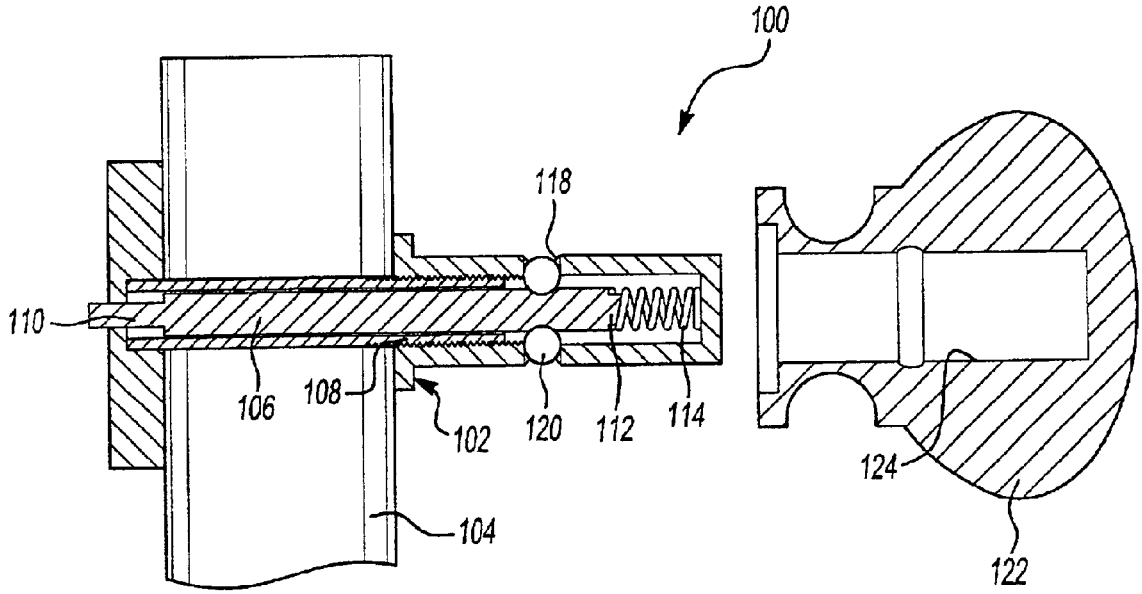
FIG. 4 is a cross-sectional view of an alternative embodiment shown with the knob body removed.
Figure 5:
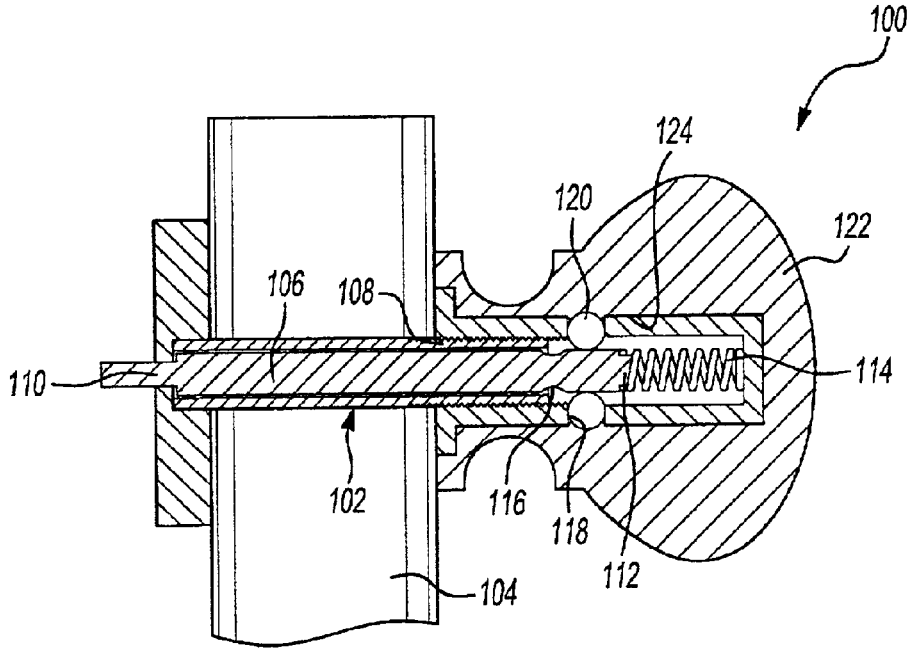
FIG. 5 is a cross-sectional view shown with the knob body mounted to a stem.

FIGS. 4 and 5 disclose an alternative means for changing the appearance of a cabinet knob 100. The alternative construction 100 includes a stem 102 fixedly mounted to a cabinet panel 104. The stem 102 includes an axial push rod 106 reciprocally mounted within a stem housing 108. A first end 110 of the push rod 106 extends from the housing 108 into the interior of the cabinet 104. A second end 112 of the push rod 106 has a spring 114 for biasing the push rod 106. The push rod 106 includes a circumferential groove 116.

The stem housing 108 has a plurality of circumferentially spaced apertures 118 for receiving ball bearings 120. The bearings 120 are moved radially outwardly by the push rod 106 but will move radially inwardly when the groove 116 aligns with the bearings 120.

A knob body 122 having an axial bore 124 matingly receives the stem 102 as is shown in FIG. 5. With the stem 102 received within the knob body 122 release of the push rod 106 will force the bearings 120 radially outwardly into locking engagement within the knob body 122. In this manner, the knob body 122 can be readily removed and replaced to conveniently alter the appearance of the cabinet hardware.

The foregoing detailed description has been given for clearness of understanding only and no unnecessary limitations should be understood therefrom as some modifications will be obvious to those skilled in the art without departing from the scope and spirit of the appended claims.

What is claimed is:

1. A hardware member adapted to be mounted to a panel of a furniture piece, said hardware member comprising:

a knob body adapted to be mounted to the furniture piece, said knob body having an axial bore receiving an elongated member attached to a fascia member to alter the appearance of said hardware member, said fascia member concealing a front end of said knob body upon insertion of said elongated member into said axial bore, said knob body including magnetic means for maintaining said elongated member within said axial bore, and the magnetic means having a center aperture extending therethrough.

2. The hardware member as defined in claim 1 wherein said elongated member has a non-circular cross-sectional configuration conforming to the configuration of said axial bore to prevent rotation of said fascia member relative to said knob body.

3. The hardware member as defined in claim 1 wherein said magnetic means for maintaining includes a magnetic member disposed within said knob body for magnetically retaining said fascia member.

4. A hardware member adapted to be mounted to a panel of a furniture piece, said hardware member comprising:

a knob body adapted to be mounted to the furniture piece, said knob body having a seat and an axial bore in communication with said seat, said seat removably receiving an interchangeable fascia member, said fascia member including an elongated member removably received within said axial bore upon insertion of said fascia member within said seat, said axial bore of said knob body including a magnetic member for magnetically attracting said elongated member to maintain said fascia member within said seat of said knob body, and the magnetic means having a center aperture extending therethrough.

5. The hardware member as defined in claim 4 wherein said elongated member has a non-circular cross-sectional configuration conforming to the configuration of said axial bore to prevent rotation of said fascia member relative to said knob body.

6. A hardware member adapted to be mounted to a panel of a furniture piece, said hardware member comprising:

a knob body adapted to be mounted to the furniture piece, said knob body having a seat formed in the front end of said knob body and an axial bore in communication with said seat; and an interchangeable fascia member removably received within said seat and axial bore to alter the appearance of said hardware member, said fascia member having an elongated member removably received within said axial bore, said knob body including magnetic means for maintaining said elongated member within said axial bore, and the magnetic means having a center aperture extending therethrough.

7. The hardware member as defined in claim 6 wherein said elongated member has a non-circular cross-sectional configuration conforming to the configuration of said axial bore to prevent rotation of said fascia member relative to said knob body.

8. The hardware member as defined in claim 6 wherein said axial bore of said knob body includes a magnetic member attracting said elongated member to removably retain said fascia member.

* * * * *